US005971817A

United States Patent [19]

Longueville

[11] Patent Number: 5,971,817

[45] Date of Patent: Oct. 26, 1999

[54] CONTACT SPRING FOR A PLUG-IN CONNECTOR

[75] Inventor: Jacques Longueville, Oostkamp, Belgium

[73] Assignee: Siemens Aktiengesellschaft, Munich, Germany

[21] Appl. No.: 09/049,560

[22] Filed: Mar. 27, 1998

Related U.S. Application Data

[63] Continuation of application No. PCT/DE96/01723, Sep. 12, 1996.

[51] Int. Cl.[6] ..... H01R 11/22

[52] U.S. Cl. ..... 439/857; 439/856

[58] Field of Search ..... 439/857, 856

[56] References Cited

U.S. PATENT DOCUMENTS 3,865,462 2/1975 Cobaugh et al. .
4,140,361 2/1979 Sochor .
4,591,230 5/1986 Roldan .
4,918,813 4/1990 Mori et al. ..... 439/857
5,004,426 4/1991 Barnett .

FOREIGN PATENT DOCUMENTS

0144128A2 6/1985 European Pat. Off. .

*Primary Examiner*—Steven L. Stephan
*Assistant Examiner*—J. F. Duverne
*Attorney, Agent, or Firm*—Herbert L. Lerner; Laurence A. Greenberg

[57] ABSTRACT

A contact spring for a plug-in connector includes spring legs (2,3) which are disposed and constructed in such a way that they are capable of exerting a compressive force from opposite sides on a contact blade (20) inserted in between and of thereby establishing contact with the contact blade. The spring legs (2,3) are disposed laterally offset with respect to each other in such a way that they do not overlap each other in the respective directions of compressive force.

7 Claims, 2 Drawing Sheets

CONTACT SPRING FOR A PLUG-IN CONNECTOR

CROSS-REFERENCE TO RELATED APPLICATION

This application is a continuation of International Application Serial No. PCT/DE96/01723, filed Sep. 12, 1996, which designated the United States.

BACKGROUND OF THE INVENTION

Field of the Invention

The present invention relates to a contact spring for a plug-in connector having two spring legs and a common supporting portion, the spring legs being disposed and formed in such a way that they are capable of exerting a compressive force from opposite sides on a contact blade inserted between them and of thereby establishing electrical contact with the latter, and the spring legs being disposed laterally offset with respect to each other in such a way that they do not overlap each other in the respective directions of compressive force.

Such a contact spring is known from U.S. Pat. No. 3,865,462. The contact springs described in that document are relatively simple to produce, but they cannot be disposed particularly closely together in series and they are also not optimal with regard to a resilient force which can be exerted by the spring legs on a contact blade inserted between them.

SUMMARY OF THE INVENTION

It is accordingly an object of the invention to provide a contact spring for a plug-in connector, which overcomes the hereinafore-mentioned disadvantages of the heretofore-known devices of this general type and which continues to be simple to produce yet functions dependably and reliably under all circumstances and permits the provision of small contact spacings in a plug-in connector.

With the foregoing and other objects in view there is provided, in accordance with the invention, a contact spring for a plug-in connector, comprising a common supporting portion having a substantially Z-like staggered cross section; and two spring legs disposed and constructed for electrically contacting a contact blade inserted between the spring legs and for exerting a compressive force in given respective directions from opposite sides upon the contact blade, and the spring legs disposed mutually laterally offset for preventing a mutual overlap of the spring legs in the respective directions of compressive force.

The effect of the z-like staggering of the supporting portion is that, even in the case of small (narrowly formed) contact springs, their spring legs can be capable of exerting a relatively high compressive force on a contact blade inserted in between, so that such contact springs function particularly well and reliably. In addition, the z-shaped staggering allows the contact springs to be disposed particularly closely together in series.

In accordance with another feature of the invention, the spring legs each have one end connected to the common supporting portion.

In accordance with a further feature of the invention, the spring legs are elongate elements with a relatively large width and a comparatively small thickness.

In accordance with an added feature of the invention, the spring legs have mutually facing broad sides lying obliquely opposite each other.

In accordance with an additional feature of the invention, the spring legs have free ends and lateral projections each widening the broad side at a respective one of the free ends.

In accordance with yet another feature of the invention, the lateral projections are each constructed to be guided and held in a guide slot in a spring chamber of a plug-in connector housing associated with the contact spring, with the free end of a respective one of the spring legs bearing against a wall of the spring chamber.

In accordance with a concomitant feature of the invention, the spring legs are inclined initially in the respective direction of compressive force and are then inclined counter to the respective direction of compressive force, starting from the common supporting portion.

Other features which are considered as characteristic for the invention are set forth in the appended claims.

Although the invention is illustrated and described herein as embodied in a contact spring for a plug-in connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
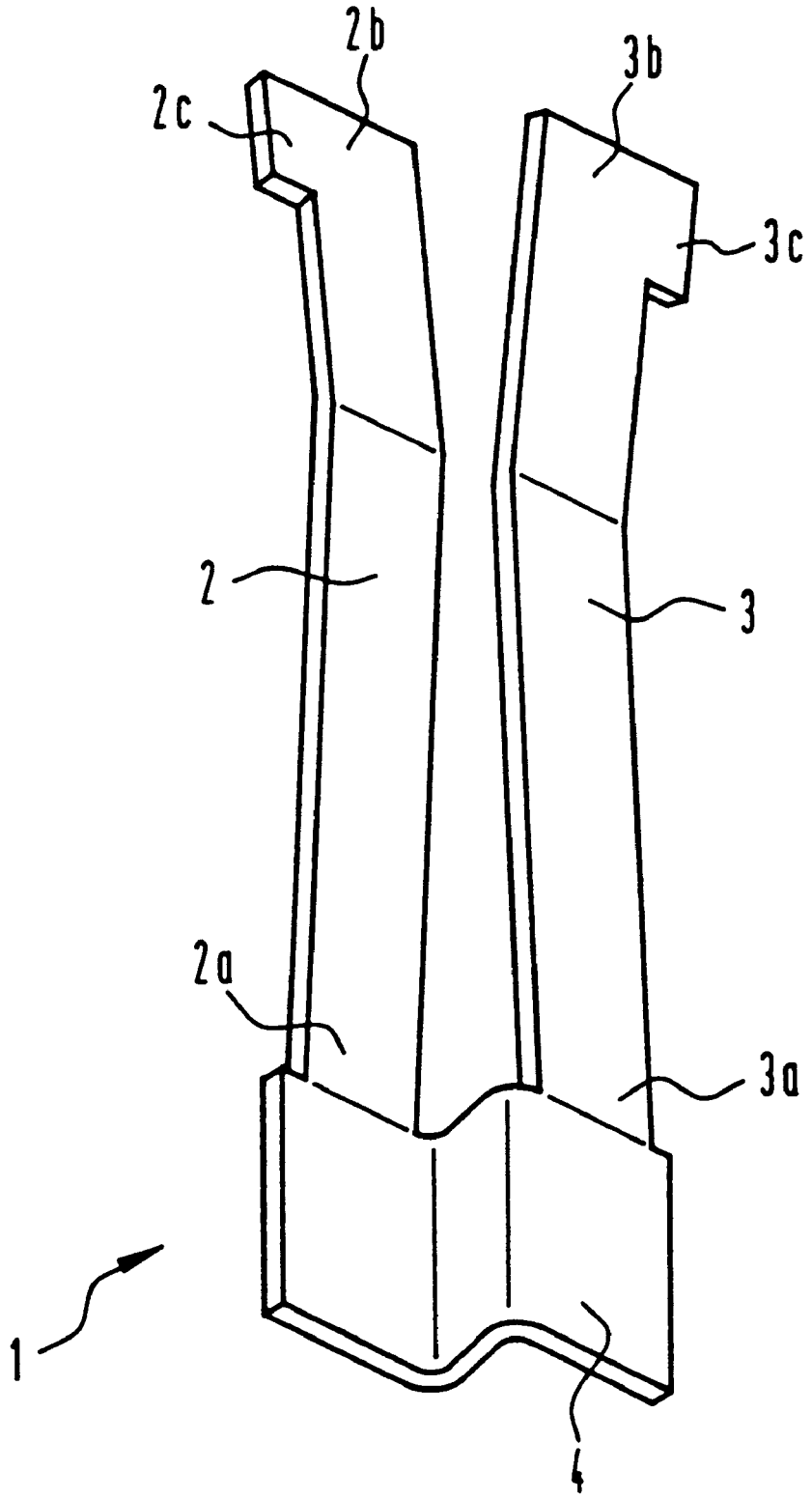
FIG. 1 is a diagrammatic, perspective view of an exemplary embodiment of a contact spring according to the invention.

Referring now to the figures of the drawings in detail and first, particularly, to FIG. 1 thereof, there is seen a contact spring 1 which includes a first spring leg 2, a second spring leg 3 and a common supporting portion 4.

The above-mentioned component parts of the contact spring are constructed as a self-contained unit and are formed of conductive material.

As can be seen from FIG. 1, the supporting portion 4 has a cross section which is staggered in a substantially Z-like manner.

The spring legs 2 and 3 are elongate elements with a relatively large width and a comparatively small thickness and they each have a respective root 2*a* and 3*a* and a respective tip 2*b* and 3*b*.

Figure 2:
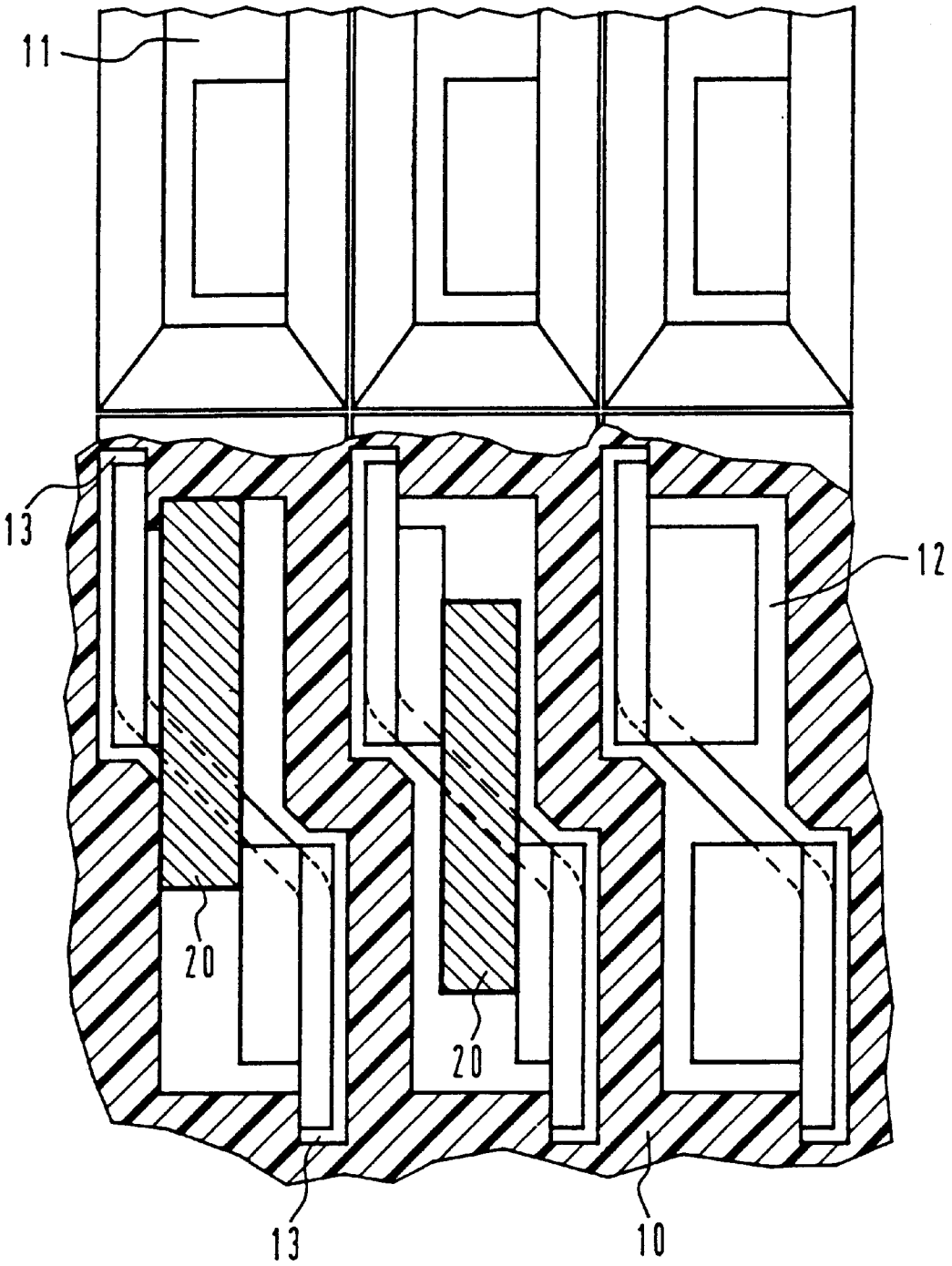
FIG. 2 is a fragmentary, partially broken-away and sectioned plan view of a connector surface of a plug-in connector containing the contact springs according to the invention.

The roots 2*a* and 3*a* are connected with the supporting portion 4 in such a way that the spring legs 2 and 3 are capable of exerting a compressive force from opposite sides, by each one of their broad sides, on a contact blade 20 inserted in between as seen in FIG. 2 and of thereby establishing contact with the latter. The roots 2*a* and 3*a* as well as the spring legs 2 and 3 are disposed laterally offset with respect to each other out of a frontal opposing position in such a way that they do not overlap each other in the respective directions of compressive force.

The two spring legs 2 and 3 are elements with a flexible construction. Starting from the respective root 2*a* and 3*a*, the spring legs 2 and 3 are inclined initially in the fib respective direction of compressive force and are then inclined counter to the direction of respective compressive force, in the relaxed state shown in FIG. 1.

The spring legs are provided with respective lateral projections 2*c* and 3*c* at the respective tips 2*b* and 3*b*, which widen at that point and, as will be explained in further detail below, serve as a securing device for the spring legs in an entry region for a contact blade with which contact is to be established.

The assembly of the above-described contact spring 1 in an electrical plug-in connector and the way in which it functions are described in detail below with reference to FIG. 2.

As can be seen from the partially sectioned, end-on plan view of the plug-in connector shown in FIG. 2, the plug-in connector has a housing 10 with a multiplicity of contact openings 11 disposed in rows (which are disposed one above the other according to the representation in FIG. 2).

As is indicated in an upper, non-sectioned portion of FIG. 2, the contact openings 11 have a rectangular opening cross section. On one hand, the dimensions of the opening cross section are adapted to the contact springs respectively lying thereunder in the assembled state and on the other hand it is constructed in such a way that a contact blade 20 with which contact is to be established by insertion has a considerable clearance available to it within which it may be misaligned or offset with respect to the center of the contact opening or the contact spring centered with respect to the latter, during fitting together.

The contact springs 1 provided under the contact openings 11 are in each case accommodated in contact chambers 12 of the plug-in connector housing 10.

The contact chambers 12 are constructed corresponding to the cross-sectional shape of the contact springs in such a way that they are staggered in a Z-like manner. Although the staggering of the contact spring 1 and the spring chamber 12 shown in FIG. 2 is likewise constructed in a Z-like manner, it is staggered in an opposite (mirror-inverted) manner with respect to the staggering of the contact spring 1 shown in FIG. 1. However, the two types of staggering are technically fully equivalent.

According to the representation shown in FIG. 2, the spring chambers 12 have guide slots 13 at their upper left and lower right ends, in other words at corner portions disposed diagonally opposite each other, as seen in the plan view. The projections 2*c* and 3*c* of the spring legs 2 and 3 are displaceably accommodated in the guide slots 13, with the contact springs inserted into the spring chambers.

The sizes of the spring chambers 12 and of the guide slots 13 are dimensioned in such a way that the projections 2*c* and 3*c* of the spring legs 2 and 3 cannot leave the guide slots 13 except during disassembly. The tips 2*b* and 3*b* of the spring legs, which are freely movable in the non-assembled state, are therefore no longer freely movable after fitting into the plug-in connector housing, unlike in the case of conventional contact springs. Rather, as is shown in FIG. 2, they bear against the spring chamber wall and cannot leave the chamber wall, depending on the above-described guiding mechanism.

Positioning and interaction of the projections 2*c* and 3*c* with the guide slots 13 allow a spring action which is completely novel for contact springs of a plug-in connector to be produced. That spring action provides an extremely reliably assurance that:

the spring legs are guided exactly into the intended position during fitting into the plug-in connector housing, the spring legs have a precisely defined zero position and consequently on one hand there is always an adequately large spring opening and on the other hand insertion behind is ruled out, the depth of insertion can be chosen to be very great, the entry region can be made very steep and consequently the insertion forces can be minimized, spring excursions of any size can be provided in a simple way, and contact forces of any magnitude can be set in a simple way.

If a plurality of the above-described spring chambers 12 with the contact springs are disposed lying next to one another in a row, as is shown in FIG. 2, a very small spacing of the contacts in the longitudinal direction (assuming that the direction of row alignment is defined as the longitudinal direction of the plug-in connector) can be achieved, even if the local width of the contact spring and of the contact chamber is chosen to be relatively great, for example due to spring excursions chosen to be great.

In spite of this high packing density, it is not necessary for a contact blade with which contact is to be established to be introduced centrally into the contact opening and brought into contact with the contact spring, such as is the case with the central contact of the lower row of contacts in FIG. 2. Rather, as can be seen from FIG. 2, there exists a relatively large clearance perpendicularly with respect to the direction of insertion, that allows a not inconsiderably offset fitting together, with respect to the central position.

Utilization of the maximum possible offset during fitting together is shown in FIG. 2 in the case of the left-hand contact in the lower row of contacts. In this case the contact blade is inserted at the upper left edge of the contact opening and of the spring contact, according to the representation in FIG. 2. In spite of this enormous deviation from the central, intended configuration, equally good contacting is possible if the contact blade is dimensioned appropriately, as can be seen from FIG. 2. As in the case of centered fitting together, a contacting of the contact blade takes place from opposite sides and the overall contact area between the contact blade and the contact spring is substantially of a constant size.

The fact that the contact blade and the contact spring can be brought into contact equally well at any point over a relatively large area has the effect of permitting the contact blade and/or the contact spring to deviate from their intended position, which until now had to be maintained quite exactly, without having the consequence of impaired contacting and/or the exertion of a force on the plug-in connector detaching it from its respective fastening, and the like.

The contact spring described herein may be produced from a punched-out metal part, by simple and uncomplicated preforming of the same.

The contact spring according to the invention consequently makes it possible to provide small contact spacings in a plug-in connector while at the same time being simple to produce as well as dependable and reliable in its function.

I claim:

1. A contact spring for a plug-in connector, comprising:

a common supporting portion having a first region and a second region laterally offset from said second region, said common portion having a substantially Z-like staggered shape, said first region and said second region forming opposite ends of said substantially Z-like staggered shape; and spring legs including a first spring leg extending from said first region of said common supporting portion, and a second spring leg extending from said second region of said common supporting portion;

said spring legs disposed and constructed for contacting a contact blade inserted between said spring legs and for exerting a compressive force in given respective directions from opposite sides upon the contact blade, and said spring legs extending mutually laterally offset for preventing a mutual overlap of said spring legs in said respective directions of compressive force.

2. The contact spring according to claim 1, wherein said spring legs each have one end connected to said common supporting portion.

3. The contact spring according to claim 1, wherein said spring legs are elongate elements with a relatively large width and a comparatively small thickness.

4. The contact spring according to claim 3, wherein said spring legs have mutually facing broad sides inclined toward each other.

5. The contact spring according to claim 4, wherein said spring legs have free ends and lateral projections each widening said broad side at a respective one of said free ends.

6. The contact spring according to claim 5, wherein said lateral projections are each constructed to be guided and held in a guide slot in a spring chamber of a plug-in connector housing associated with the contact spring, with said free end of a respective one of said spring legs bearing against a wall of the spring chamber.

7. The contact spring according to claim 2, wherein said spring legs are inclined initially in said respective direction of compressive force and are then inclined counter to said respective direction of compressive force, starting from said common supporting portion.

* * * * *

UNITED STATES PATENT AND TRADEMARK OFFICE

CERTIFICATE OF CORRECTION

PATENT NO. : 5,971,817

DATED : October 26, 1999

INVENTOR(S) : Jacques Longueville

It is certified that error appears in the above-identified patent and that said Letters Patent is hereby corrected as shown below:

On the title page:

Item [30] should read as follows:

Sep. 27, 1995 [DE] Germany ..... 195 35 988.7

Signed and Sealed this

Twenty-eighth Day of November, 2000

*Attest:*

Q. TODD DICKINSON

*Attesting Officer*

*Director of Patents and Trademarks*